United States Patent [19]

Cheruvu

[11] Patent Number: 4,705,623

[45] Date of Patent: Nov. 10, 1987

[54] HYDROSIZING METHOD AND APPARATUS

[75] Inventor: Subrahmanyam Cheruvu, Mercerville, N.J.

[73] Assignee: Mobil Oil Corporation, New York, N.Y.

[21] Appl. No.: 804,572

[22] Filed: Dec. 4, 1985

Related U.S. Application Data

[63] Continuation-in-part of Ser. No. 644,081, Aug. 24, 1984, abandoned.

[51] Int. Cl.[4] ..... B03B 5/64; B03B 5/66

[52] U.S. Cl. ..... 209/161; 209/160; 209/454

[58] Field of Search ..... 209/160, 161, 158, 159, 209/13, 18, 423, 424, 138, 466, 454, 474

[56] References Cited

U.S. PATENT DOCUMENTS

| | | | |
|---|---|---|---|
| 494,209 | 3/1893 | Krampf . | |
| 1,012,151 | 12/1911 | Polglase et al. . | |
| 1,035,145 | 8/1912 | Beeken | 209/158 |
| 1,058,828 | 4/1913 | Wiggin et al. | 209/160 |
| 1,193,953 | 8/1916 | Wagner . | |
| 2,025,412 | 12/1935 | Hardy | 209/161 |
| 2,586,818 | 2/1952 | Harms . | |
| 2,666,526 | 1/1954 | Odell et al. . | |
| 2,708,517 | 5/1955 | Evans . | |
| 2,784,841 | 3/1957 | Evans | 209/158 |
| 2,967,617 | 1/1961 | Evans | 209/158 |
| 3,032,194 | 5/1962 | Evans et al. . | |
| 3,075,643 | 1/1963 | Delachanal . | |
| 3,102,092 | 8/1963 | Heath et al. . | |
| 3,237,767 | 3/1966 | Fowle | 209/160 |
| 3,261,559 | 7/1966 | Yavorsky | 209/454 |
| 3,282,422 | 11/1966 | Reynolds et al. . | |
| 3,446,352 | 5/1969 | Sahores | 209/161 |
| 3,774,759 | 11/1973 | Weintraub et al. . | |
| 3,867,197 | 2/1975 | Reinhardt et al. . | |
| 4,039,425 | 8/1977 | Neavel . | |
| 4,116,823 | 9/1978 | Choi | 209/138 X |

FOREIGN PATENT DOCUMENTS

| | | | |
|---|---|---|---|
| 459451 | 1/1937 | United Kingdom | 209/160 |
| 768464 | 9/1978 | U.S.S.R. | 209/161 |

OTHER PUBLICATIONS

Taggart-"Handbook of Mineral Dressing", Copyright 1945, Published by John Wiley and Sons, New York, Section 8-43 to 8-58.

*Primary Examiner*—S. Leon Bashore
*Assistant Examiner*—Thomas M. Lithgow
*Attorney, Agent, or Firm*—Alexander J. McKillop; Michael G. Gilman; Charles J. Speciale

[57] ABSTRACT

An apparatus and method for separating particulate solid from a solid mixture based on the size of the particles which includes feeding a slurry of the particulate solid mixture into an upper vessel portion adapted to be filled with liquid such as the slurried particulate. The apparatus also includes a lower vessel portion having a cross-sectional area which is less than the cross-sectional area of the upper vessel portion and is sealingly connected for fluid communication with the upper vessel portion by an outwardly diverging wall located at the top of the lower vessel portion. The upper vessel portion has a free-settling region for separating particulate solids. The particulate containing slurry is met with an upwardly directed stream of fluidization fluid, e.g., water, in the lower vessel portion wherein a first fraction-containing solid particulate which has descended through the fluidization stream is directed from the apparatus by a means therefor. A second fraction containing substantially fines is removed from the top of the upper vessel portion. In a preferred embodiment of the invention, an additional separation operation is performed by use of an additional reduced-size vessel.

47 Claims, 3 Drawing Figures

HYDROSIZING METHOD AND APPARATUS

BACKGROUND OF THE INVENTION

This application is a continuation-in-part application of Ser. No. 644,081 filed 8-24-84 (now abandoned).

The present invention relates to the sorting and separating of solid particulate from mixtures thereof based on size and density, and, in particular, to an improved method and apparatus for performing such sorting and separating function.

In the past, the requirement for sorting gross amounts of solid particulate by size from mixtures thereof has frequently arisen, especially for classifying mining products such as mineral phosphate material. A number of different types of devices have been provided to accomplish such tasks.

One type of classifier employs the use of a continuous fluidized bed to effect separation, such as the system disclosed in U.S. Pat. No. 3,102,092 to Heath, et al. In this type of system particles introduced as a feed into a vessel are subjected to an uprising stream of gas moving at such velocity as to carry with it particles smaller than a preselected size. This system, which relies strictly on fluidized bed principles and does not combine free-settling principles with a fluidized bed, includes two connected fluidized beds, each operating to cause different size particle separation. In particular, one fluidized bed separates at about 1.5 to 3.0 times larger particles than the other fluidized bed, which operates at preselected particle size separation. Consequently, the intermediate size particles build-up in the section connecting the two fluidized beds to a high density and they are believed plunge to the bottom for removal. Such particle build-up and removal causes cyclical operating conditions and is not desirable for good particle classification in most cases. It has also been known to use different classifying methods such as free settling which is conventionally defined as the settling of individual particles by gravity from a dilute slurry (typically below about 10% solids by volume). Another method is hindered settling which involves settling of particles through a bed of fluidized particles wherein the concentration of solids is significantly higher than in the case of free settling.

In one type of hydraulic classification apparatus that has been used, different principles of classification have been employed. For example, a classification system has been known in which three columns of different diameters are positioned vertically one above the other, the uppermost column having the largest diameter and the intermediate column having the smallest diameter. The three columns are in fluid communication with each other so that the fluid which is introduced in the lowermost column as an upwardly directed stream is confined to the columns. The effect of the constriction provided by the middle column is that certain particles which settle through the uppermost column against the rising slurry provided therein fall to the constriction but cannot fall further. See U.S. Pat. Nos. 2,708,517; 2,784,841; and 3,032,194.

This constricted area, however, presents problems in that it hinders the transport of near size or intermediate size particles which settle through the upper vessel, but which are not large or dense enough to pass through the high velocity fluid in the constricted zone. Consequently, these intermediate-size particles accumulate above this constricted zone, usually in a diverging section connecting the intermediate column to the upper column, until high density is reached which plunges to the bottom for removal from the system, thereby causing material inversion and system instability.

Moreover, when the solids feeding rate to the machine changes, the existence of two different upward velocities (one in the constricted area and the other at the larger-diameter bottom section) does not permit rapid and responsive self-adjustment of the system dynamics. Furthermore, the venturi effect promulgated by the flow of the upward stream of fluid from the larger diameter bottom section to the constricted middle section and thence to the diverging upper section cause unpredictable flow currents which cannot be compensated by design features.

Devices of the type discussed above have been found to present other problems related to construction and maintenance. In particular, since the three diameter structure is very complex to fabricate and maintain, unnecessary expense is incurred in building and upkeep.

Another problem incurred in the use of hydrosizers having a hydraulically fluidized particle bed such as disclosed in the prior art is the need for a significant amount of fluidization water (also called teeter water).

It is, therefore, an object of the present invention to overcome these and other problems associated with the sorting of solid particulate from a solids mixture according to size.

SUMMARY OF THE INVENTION

The present invention includes a hydraulic method and classifying apparatus for separating particulate solids from a solid mixture into at least two groups based on the size and/or density of the particles. The apparatus includes an upper vessel portion, adapted to be filled with liquid, for receiving a slurry containing the solid particle mixture, a lower upright vessel portion having a constant cross section area which is reduced in size from the cross sectional area of the upper vessel. The lower vessel portion also has an upwardly diverging wall at the top which is sealingly connected to the bottom of the upper vessel portion so that the upper vessel portion is in fluid communication with the lower vessel portion.

At the lower end of the lower vessel portion there is also included a fluidization zone which includes a means for introducing an upwardly directed stream of fluidization fluid, such as water. A first means for directing solid particulate out of the apparatus is mounted in the lower vessel at a position immediately above the means for introducing the upwardly directed stream of fluidization fluid so that solid particulate which descends through the upwardly directed stream can be directed out of the lower vessel portion. There is also provided at least a second means for removing solid particulate which is mounted on the upper vessel portion at a position in which fine containing slurry can be directed away. The apparatus can also include in the upper vessel portion a conduit for introducing the mixture of solid particulate as a slurry into the bottom portion of the upper vessel.

The fluidization zone looated in the lower vessel portion can include a grid means extending across the interior of the lower vessel portion immediately below the first removing means whereby solid particulate is prevented from passing therethrough. Preferably, the grid means is also located above the source of fluidization fluid.

In a preferred embodiment of the invention, the above-described apparatus is constructed so that the ratio of cross sectional area of the upper vessel portion to the cross sectional area of the lower vessel portion can be from about 10:1 to about 2:1, and in one embodiment can be about 8:1. In another embodiment the ratio can be from about 5:1 to about 2:1, and preferably about 3:1.

Another preferred feature of the invention is that the height of the lower vessel portion can be from about 8' to about 20', and preferably about 12', while the height of the upper portion can be from about 5' to about 12', and is preferably about 10'. Relative to the lower vessel portion, the ratio of the height of the lower portion to the diameter of the lower vessel portion is preferably from about 1:1 to about 5:1.

A further preferred embodiment of the invention can include means for adding additional fluid, e.g., water, to the frusto-conical shaped zone defined by the upwardly diverging wall, which can be from about 1 to about 6 pipes fixed vertically in the upper vessel portion or fixed for introducing the fluid tangentially into the zone defined by the upwardly diverging walls. The height of this zone can be from about 4' to about 12', and is preferably about 8', so that effective isolation can be made between the free settling region in the upper portion and the fluidized bed region in the lower vessel portion.

In another preferred embodiment of the invention, the apparatus includes an additional reduced size vessel having a constant cross sectional area and which is adapted to be filled with liquid for receiving the slurry effluent resulting from the first removing means. A second fluidization zone is located at the lower portion of the additional vessel which includes a second means for introducing an upwardly directed stream of fluidization fluid, a third means for removing solid particulate mounted in the additional vessel at a point immediately above the second means for introducing fluidization fluid so that solid particulate which descends through the upwardly directed stream is removed from the additional vessel. Finally, a fourth means for removing solid particulate is mounted on the upper part of the additional vessel so that coarse flotation feed can be removed. The second fluidization zone can also include a grid means, as in the first fluidization zone, which extends across the interior of the additional vessel at a position below the third removing means whereby solid particulate is prevented from passing therethrough.

The process of the present invention contemplates introduction of solid particle mixture in a slurry form to the upper vessel portion of the hydraulic classifying apparatus and feeding a stream of fluidization fluid upwardly against the slurry as it descends from the upper vessel portion into the lower vessel portion of the apparatus.

The introduction of the slurry and the feeding of fluidization fluid, e.g., water, can be controlled to provide a free settling separation region in the upper vessel portion and a fluidized bed separation in the lower vessel portion. The slurry can be introduced into the upper vessel portion at a rate of from about 1,000 gpm to about 15,000 gpm, for typical classification in phosphate beneficiation, while the fluidization fluid can be fed into the lower vessel portion at a rate of from about 500 gpm to about 5,000 gpm, for typical applications in phosphate beneficiation. Overall, the velocity of the fluid in the free settling region in the upper vessel portion is from about 1.0 ft/min. to about 20 ft/min., and preferably about 4 ft/min., while the velocity of fluid in the fluid bed region in the lower vessel portion is from about 0.3 ft/min. to about 15 ft/min., and is preferably about 1.5 ft/min. for particles classification by size in phosphate beneficiation where particle density is about 3.0 gm/cm$^3$ and separation size is 16 mesh to 100 mesh.

A first fraction of particulate in a fluidized slurry can be directed from the lower vessel portion at a position immediately above the level at which the fluidization stream is introduced, and a second fraction of particulate in the slurry is removed from the upper vessel portion generally at the top thereof. By this means, heavier coarse particulate is separated in the first fraction while fine particulate is removed in the second fraction.

The present method also contemplates introduction of the first fraction of particulate in fluidized effluent into the additional reduced size vessel and feeding a second stream of fluidization fluid upwardly against the slurry effluent. A third fraction of particulate in fluidized slurry can be directed away from the lower portion of the additional vessel at a position immediately above the level at which the second fluidization stream is introduced, while a fourth fraction can be removed from the upper portion of the additional vessel whereby heaviest sizer rock particulate is separated in the third fraction and coarse flotation feed is removed in the fourth fraction.

The present method and apparatus is designed to be especially effective in the separation of particulate phosphate rock which results in a first fraction having particulate with a predominant particle size of greater than about 42 mesh. Predominant in this instance means less than about 30% of the total particulate content is less than 42 mesh, and preferably from about 20%–25% of the total particulate content is less than 42 mesh.

The second fraction of solid particulate can have a predominant particle size of less than about 42 mesh, which means that less than about 6% of the total particulate content is greater than 42 mesh, preferably less than about 4% of the total particulate, and most preferably only between about 2%–4% of the total particulate content is greater than 42 mesh.

Furthermore, in the case of phosphate rock, the present process contemplates producing a third fraction which includes solid particulate having a predominant particle size of greater than about 20 mesh , e.g., preferably less than about 35% of the total particulate content being less than 20 mesh , and most preferably only from about 25% to about 30% of the total particulate content is less than 30 mesh.

The fourth fraction which results from the present process and apparatus in the case of its use with phosphate rock includes solid particulate having predominant particle size of less than about 20 mesh such that less than about 6% of the total particulate content is greater than 20 mesh, preferably less than 4% of the total particulate is greater than 20 mesh, and most preferably only from about 1% to about 3% of the total particulate is greater than 20 mesh .

As a result of the present invention, an apparatus is provided which is less expensive and easier to build, operate, and maintain due to its much simpler geometry, simpler fine removal, and fewer parts. Furthermore, high quality plus 20 mesh rock and flotation feeds are produced at comparatively low water use.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

A preferred embodiment of the invention has been chosen for purposes of illustration and description and are shown in the accompanying drawings, wherein.

DETAILED DESCRIPTION OF THE INVENTION

Figure 1:
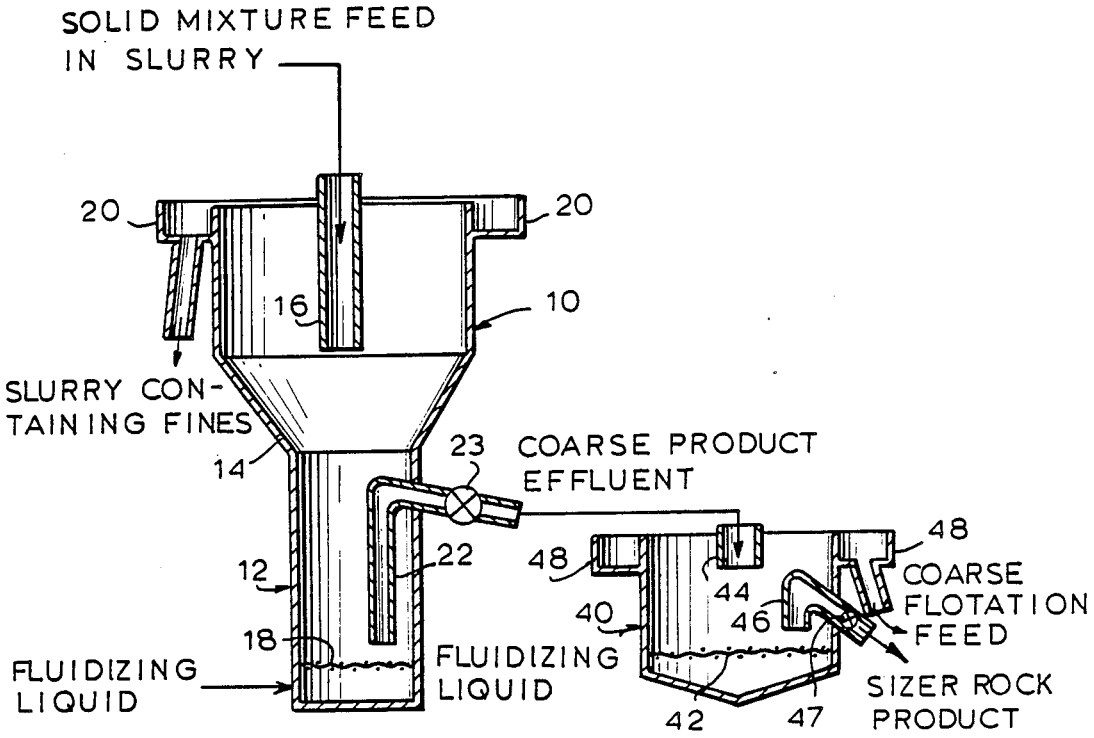
FIG. 1 is a schematic of an apparatus useful in the process of the present invention.

Referring to FIG. 1 (similar features on each of the drawings have been designated with like numerals, but distinguished with prime notations), there is shown on the left-hand side a classifying apparatus according to the present invention which includes an upper vessel portion 10 and a lower vessel portion 12. The upper vessel portion 10 is adapted to contain a slurry which is used in the classification or sizing of solid particulate from a particulate mixture. The method of separation in the upper vessel portion 10 is a free settling method and it has been found that the height of the upper vessel portion can be from about 5' to about 12', depending on the volumetric flow rates. The velocity of water in the upper vessel portion can be from about 1 ft/min. to about 20 ft/min., and is preferably about 4 ft/min.

The lower vessel portion 12 is upright and has a constant cross sectional area from top to bottom which is reduced in size from the cross sectional area of the upper vessel portion 10. The method of separation in the lower vessel portion 12 is fluidized bed separation and it has been found that the height of the lower vessel portion can be from about 8' to about 20' in order to minimize any serious interferences between the two settling phenomena, while the ratio of the fluidized bed height to diameter can preferably be from about 1:1 to about 5:1. Moreover, the velocity of the fluid in the lower vessel portion is preferably from about 0.3 ft/min. to about 15 ft/min. and is preferably about 1.5 ft/min. While it is customary that such vessels have a generally circular configuration, the present invention is not so constrained and the apparatus can have any type of enclosed configuration such as multilateral.

Figure 2:
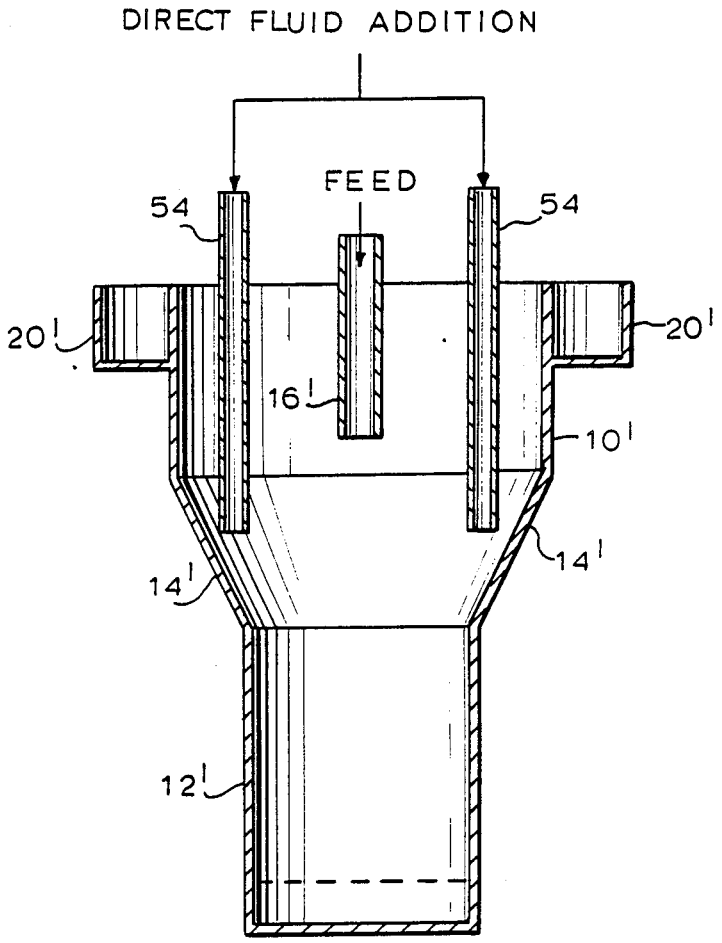
FIG. 2 is a schematic of a further embodiment of the present invention which includes additional fluid introducing means.
Figure 3:
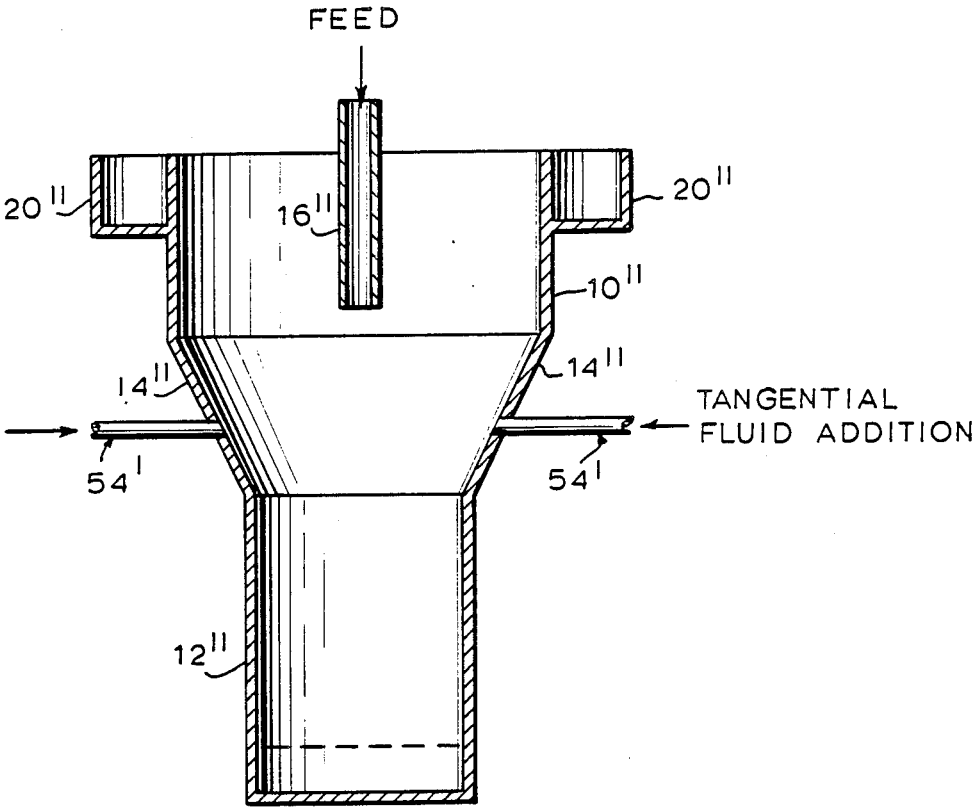
FIG. 3 is a schematic of yet another alternative of the invention as shown in FIG. 2.

The lower vessel portion 12 also includes an outwardly diverging upper wall portion 14 which is sealingly connected to the upper vessel portion 10 at the lower part thereof so that the upper vessel portion 10 is in fluid communication with a lower vessel portion 12. This outwardly diverging wall portion 14 defines a frusto-conical zone in the apparatus which separates the upper portion free settling region from the lower portion fluidized bed region. In order to achieve better separation of the zones the height of this frusto-conical portion can be from about 4' to about 12', and preferably is about 8', depending on the separation desired. In order to aid in the prevention of accumulation of near size material in the conical zone, e.g., near 42 meshsize when the separation is at 42 mesh, and to adjust the fluid rise velocity in the upper vessel, fluid, such as water, can be added into the conical zone tangentially via pipes 54' (in FIG. 3), or directly via vertical pipes 54 (in FIG. 2) at a rate of up to about 3,000 gpm , preferably at a ratio of from about 200 gpm to about 1,500 gpm, and most preferably at about 1,000 gpm . The number of pipes included to introduce the additional fluid can be from about 1 to 6, and preferably is 3 pipes.

In one embodiment of the invention, the upper vessel portion can include a feed conduit 16 for introducing the solid particulate mixture in slurry form into the classifying apparatus. The point of introduction as shown in the present drawing, is preferably in the upper vessel, especially, at the lower part of the upper vessel portion 10. The slurry can preferably be introduced at a rate of from about 4,000 gpm to about 12,000 gpm , when the slurry contains from about 25% to about 35% solids.

Referring to the lower vessel portion, there can be seen a means for introducing fluidizing fluid, such as liquid, which, in a preferred embodiment, is water under pressure forced into the bottom and through a grid means 18. The stream of water is directed upwardly to meet the descending particulate-containing slurry at a velocity such that the larger particulate solid, or more dense particulate solids continue to descend through the upwardly directed stream, while the smaller (or less dense) particulate solids continue to travel upwardly in the apparatus or teeter at some level therein. When water is used as the fluidizing medium, it is introduced to maintain a certain ratio of water to settling solids in the bottom section 12. It is preferred that a constant weight ratio of water to solids be maintained in the lower vessel portion, e.g., from about 1:1 to about 5:1 when the particulate matter is phosphate rock, and that the rate of introduction of the stream of water should be from about 1,000 gpm to about 3,000 gpm . Since the feed slurry in the case of phosphate mineral rock contains from about 25% solids to about 35% solids, while the remaining part of the slurry is water, the overall apparatus is primarily filled with rising water containing solids. Consequently, the very light material or fine product is carried upwardly to the top of the upper portion of the vessel where it can be conveniently removed by a launder 20.

In the lower vessel portion, there is mounted a first means for directing particulate solids from the apparatus, such as conduit 22 which can be operated at any time by opening valve 23. The valve 23 can be operated by suitable instrumentalities to automatically open and discharge particles when the fluidized particle bed builds up to the requisite amount. This type of product is referred to as coarse product and generally is considered as the product having a particle size of greater than one of the selected sized indicated above. The bottom section can also include a grid 18 which has openings that not only provide streams of water in the upward direction, but which also prevent solid particulate from falling therethrough. Since there is a constant volume of water flowing through the bottom portion located beneath the grid, any smaller particulate matter which finds its way to that level will be forced upwardly either to the upper part of the vessel and/or through the conduit 22.

Systems for hydrosizing particulate matter known in the past have generally included a lower vessel portion having a larger cross sectional area than the restricted vessel portion located immediately thereabove wherein, as a result of the water being introduced into the lower larger vessel portion, a very high upward velocity stream of fluid is created as a result of this constriction, which causes system instability and adversely effects sizing efficiency. The present invention, however, overcomes such defects associated with these devices by use of a constant cross sectional area lower upright vessel portion wherein a constant water velocity can be maintained, which is highly controllable and self-adjusting. This constant area lower upright section is also less expensive to build and maintain due to simplicity in construction.

In a further preferred embodiment of the present invention, there is also included an additional classifying vessel 40 which, according to the present invention, can be a reduced size vessel having a constant cross sectional area and a fluidization zone at the lower portion thereof into which fluidizing liquid is introduced preferably up through a second grid means 42. As in the first fluidization zone, the second grid means has openings which create upwardly directed streams of water and also prevent passage therethrough of larger solid particulates.

In operation, the additional vessel is used with the main classifying apparatus by introducing the coarse product effluent into the additional vessel such as through a conduit 44. Fluidizing fluid such as water is fed under pressure into the lower portion of the additional vessel 40 so that upwardly directed stream of fluidization liquid meets the incoming coarse product effluent. As a result of the design of the additional vessel, e.g., the height and cross sectional area, as well as the highly controllable velocity of the upwardly directed stream of fluidization liquid, the solid particulate feed is further divided into two parts which, in one commercial application of phosphate beneficiation, includes sizer rock generally considered as being greater than 20 mesh, and coarse flotation feed which is generally considered to be less than 20 mesh. The larger particles are directed away from the additional vessel by use of a third means for removing, such as conduit 46, the opening of which is located at a position just above the fluidization liquid so that heavier particles descending through the upwardly directed stream can be removed from the additional vessel by an automatically opening valve 47. The volume of water used in the additional vessel which is the result of the addition of the coarse product effluent slurry plus the fluidization liquid introduced therein carries the smaller particles to the top portion thereof and can be removed in a slurry form by launder 48.

Another characteristic of the present invention is the relationship of the cross-sectional area of the upper vessel portion to the cross-sectional area of the lower vessel portion in the main classifying vessel which is preferably from about 10:1 to about 2:1, and in one embodiment is about 8:1. In another embodiment the preferred ratio is from about 5:1 to about 2:1, and preferably about 3:1. The actual cross-sectional area of the upper vessel portion can be from about 100 sq. ft. to about 1000 sq. ft.

With respect to the additional vessel, it is generally considered adequate to have a height dimension of about 8′ to 16′ while the diameter (in the case of a circular vessel) is variable, depending on the application.

An important feature of the present invention is the flexibility provided by very simply designed apparatus to optimize equipment use in attaining desired classification goals. Depending on the required final product size distribution, the weight ratio of fine particles to coarse particles in the feed stream, fluidization water availability and product quality criteria, a simple device with top and bottom sections having different cross-sectional areas and different classification regions, such as the main classifying vessel, and/or a device having a constant cross-sectional area, such as the additional vessel, can easily be combined to meet the needs.

In general, the two-dimensioned unit of the invention, especially in combination with the frusto-conical separation zone, offers great flexibility in changing mesh "cut" point without upsetting changing water flow rate and is much less expensive than the three-diameter units known in the art. Similarly, the single diameter units are extremely simple in design resulting in further economy in fabrication and maintenance.

Furthermore, since the use of the additional vessel in combination with main classifying vessel quite satisfactorily performs the desired separation, the traditional practice of using two full-sized similar type hydrosizers has been revolutionized thus resulting in more efficient use of the large equipment and/or apparatus, as well as reduction in the need for high volumes of water.

EXAMPLES

Actual runs were made using the main classifying vessel of the present invention for hydrosizing phosphate particles recovered from mines in Florida. Fine produce (in this case minus 42–plus 150 mesh) and coarse product (in this case minus 20–plus 42 mesh) were produced. Usually the practice has been to use two similarly designed hydrosizers in order to achieve effective separation of the different fractions. The results of the runs made using the present invention are shown below in Table I.

TABLE I

| Product | Quality of Fraction |
|---|---|
| Fine Product −42 mesh | 2% to 4% of the total particulate content was found to be greater than 42 mesh (i.e., +42 mesh). |
| Coarse Product +42 mesh | 20 to 25% of the total particulate content was found to be less than 42 mesh (i.e., −42 mesh). |

As can be seen by the above results, only 2% to 4% of the particulate content in the fine flotation product was greater than a 42 mesh size, while in the case of coarse product, only 20% to 25% of the total particulate content was found to be less than 42 mesh, indicating an efficient and accurate sizing process.

Further runs were conducted using the combined apparatus of the present invention, the results of which are shown in Table II. Fine flotation feed (minus 42–plus 150 mesh), coarse flotation feed (minus 20–plus 42 mesh), and sizer rock (minus 14–plus 20 mesh ) were generated.

TABLE II

| Product | Quality of Fraction |
|---|---|
| Fine Flotation Feed −42 mesh to +150 mesh | 2% to 4% +42 mesh |
| Coarse Flotation Product −20 mesh to +42 mesh | 1% to 3% +20 mesh |
| Sizer Rock Product −14 mesh to +20 mesh | 25% to 35% −20 mesh |

It can be seen from the above results of the runs with the combined apparatus that the present invention provides a highly accurate sizing process with minimal equipment and complexity.

However, while there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. Hydraulic classifying apparatus for separating particulate solids from a solid particle mixture into at least two groups based on the size and/or density of the particles comprising:

an upper vessel portion, adapted to be filled with liquid, for receiving a slurry containing said solid particle mixture, a lower upright vessel portion having a constant cross-section area which is reduced in size from the cross sectional area of said upper vessel, and an upwardly diverging wall at the top thereof which is sealingly connected to the bottom of said upper vessel portion whereby said upper vessel portion is in fluid communication with said lower vessel portion, a fludization zone being defined by the lower end of said lower vessel portion and a grid disposed within said lower vessel portion at a position above said lower end, said fluidization zone including means for introducing an upwardly-directed stream of fluidization fluid, conduit discharge means for directing larger and/or denser solid particulate out of said apparatus which is mounted in said lower vessel portion, said conduit having a downwardly open first end which is positioned above said grid and an opened second end extending through a side of said lower vessel whereby larger and/or denser solid particulate which descends through an upwardly-directed stream of fluidization fluid is received by said first opened end and is directed out of said lower vessel portion though said second open end, and second discharge means for removing smaller and/or less dense solid particulate mounted on said upper vessel portion at aposition in which smaller and/or dense particulate containing slurry is didrected away.

2. The apparatus of claim 1, wherein said upper vessel portion further comprises a conduit feed means for introducing said mixture of solid particulate as a slurry into the bottom portion of said upper vessel portion.

3. The apparatus of claim 1, wherein said grid means is above said means for introducing an upwardly-directed stream of fluidization fluid.

4. The apparatus of claim 1, wherein the ratio of cross-sectional area of said upper vessel to the cross-sectional area of said lower vessel portion is from about 10 to 1 to about 2 to 1.

5. The apparatus of claim 4, wherein said ratio is about 8 to 1.

6. The apparatus of claim 4, wherein said ratio is from about 5 to 1 to about 2 to 1.

7. The apparatus of claim 6, wherein said ratio is about 3 to 1.

8. The apparatus of claim 1, wherein the height of said lower portion is from about 8′ to about 16′ and the height of said upper portion is from about 5′ to about 12′.

9. The apparatus of claim 1 wherein the ratio of the height of said lower portion to the diameter of said lower portion is from about 1 to 1 to about 5 to 1.

10. The apparatus of claim 1 wherein said upwardly diverging wall defines a frusto-conical zone between said upper portion and said lower portion having a vertical height of from about 4′ to about 12′.

11. The apparatus of claim 10 wherein said height is about 8′.

12. The apparatus of claim 1 wherein said means for introducing fluidization fluid comprising means for introducing water as said fluidization fluid.

13. The apparatus of claim 10 which further comprises means for adding additional liquid to said frusto-conical zone defined by said upwardly diverging wall.

14. The apparatus of claim 13, wherein said adding means comprises from about 1 to about 6 pipes vertically fixed for introducing said water into said zone defined by said upwardly diverging wall.

15. The apparatus of claim 13, wherein said adding means comprises from about 1 to about 6 pipes fixed for introducing said water tangentially into said zone defined by said upwardly diverging wall.

16. The apparatus of claim 1 which further comprises an additional reduced-size vessel having a constant cross-sectional area, and which is adapted to be filled with liquid, said additional reduced-size vessel being positioned such that said conduit discharge means for directing larger and/or denser solid particulate out of said apparatus, discharges the slurry effluent resulting from said opened second end into said additional reduced size vessel, a second fluidization zone at the lower portion of said additional vessel which includes second means for introducing an upwardly-directed stream of fluidization fluid, third discharge means for removing solid particulate mounted in said additional vessel at a point immediately above said second means for introducing fluidization fluid whereby solid particulate which descends through an upwardly-directed stream of fluidization fluid is directed out of said additional vessel, and fourth discharge means for removing solid particulate mounted on the upper portion of said additional vessel.

17. The apparatus of claim 16, wherein said second fluidization zone further comprises a grid means extending across the interior of said additional vessel at a position below said third discharge means whereby solid particulate is prevented from passing therethrough.

18. A process for separating particulate solids from a solid particulate mixture into at least two fractions based on the size and density of the particles including a first fraction having denser, coarse particulate and a second fraction having fine particulate comprising:

introducing a slurry of said particulate mixture in a fluid into a lower part of an upper vessel portion of a hydraulic classifying apparatus which is adapted to be filled with a liquid, feeding a stream of fluidization fluid into a lower upright vessel portion upwardly against said slurry as it descends from said upper vessel portion into the lower upright vessel portion of said apparatus, said lower portion having a constant cross-section area which is reduced in size from the cross-sectional area of said upper portion and an upwardly diverging wall at the top thereof which is sealingly connected to the bottom of said upper vessel portion whereby said upper vessel portion is in fluid communication with said lower vessel portion, controlling said slurry introduction into said upper vessel portion and said fluidization fluid feeding into said lower vessel portion to provide a free settling separation in said upper vessel portion and a fluidized bed separation of said particulate mixture in said lower vessel portion, directing a first fraction of particulate in a fluidized slurry from said lower vessel portion through a downwardly open first end of a conduit discharge means which is positioned in said lower vessel portion immediately above the level at which said fluidization stream is introduced, said conduit discharge means further comprising an opened second end extending through a side of said lower vessel portion, and removing a second fraction of particulate in slurry from said upper vessel at the top portion thereof, whereby denser, coarse particulate is separated in said first fraction and fine particulate is removed in said second fraction.

19. The process of claim 18 wherein said slurry having from about 25% to about 35% solids content is introduced into said upper vessel portion at a rate of from about 1,000 gpm to about 15,000 gpm.

20. The process of claim 19 wherein said rate is from about 4,000 gpm to about 12,000 gpm.

21. The process of claim 18 wherein said fluidization fluid is fed into said lower vessel portion at a rate of from about 500 gpm to about 5,000 gpm.

22. The process of claim 21 wherein said rate is from about 1,000 gpm to about 3,000 gpm.

23. The process of claim 18 wherein the upward velocity of fluid in said upper vessel portion is from about 1 ft/min. to about 20 ft/min. and the upward velocity of fluid in said lower vessel portion is from about 0.3 ft/min. to about 15 ft/min.

24. The process of claim 23 wherein said upper vessel portion liquid velocity is about 4 ft/min. and said lower vessel portion liquid velocity is about 1.5 ft/min.

25. The process of claim 18 which further comprises introducing said first fraction of particulate in a fluidized slurry effluent into an additional reduced-size vessel having a constant cross-sectional area and which is adapted to be filled with liquid, feeding a second stream of fluidization fluid upwardly against said slurry effluent, directing a third fraction of particulate in a fluidized slurry from the lower portion of said additional vessel at a position immediately above the level at which said second fluidization stream is introduced, and removing a fourth fraction of particulate in slurry from the upper portion of said additional vessel.

26. The process of claim 18, wherein said particulate solids comprises phosphate rock.

27. The process of claim 26, wherein said first fraction comprises solid particulate having a predominant particle size of greater than 42 mesh.

28. The process of claim 27, wherein less than about 30% of the total particulate content of said first fraction is less than 42 mesh.

29. The process of claim 18, wherein from about 20 to about 25% of the total particulate content of said first fraction is less than 42 mesh.

30. The process of claim 18, wherein said second fraction comprises solid particulate having a predominant particle size of less than 42 mesh.

31. The process of claim 30, wherein less than about 6% of the total particulate content of said second fraction is greater than 42 mesh.

32. The process of claim 31, wherein less than about 4% of the total particulate content of said second fraction is greater than 42 mesh.

33. The process of claim 32, wherein between about 2 and about 4% of the total particulate content of said second fraction is greater than 42 mesh.

34. The process of claim 25, wherein said particulate solids comprises substantially phosphate rock.

35. The process of claim 34, wherein said third fraction comprises solid particulate having a predominant particle size of greater than 20 mesh.

36. The process of claim 35, wherein less than about 35% of total particulate content of said third fraction is less than 20 mesh.

37. The process of claim 36, wherein from about 25 to about 30% of total particulate content of said third fraction is less than 20 mesh.

38. The process of claim 34, wherein said fourth fraction comprises solid particulate having a predominant particle size of less than 20 mesh.

39. The process of claim 38, wherein less than about 6% of total particulate content of said fourth fraction is greater than 20 mesh.

40. The process of claim 39, wherein less than about 4% of total particulate content of said fourth fraction is greater than 20 mesh.

41. The process of claim 40, wherein from about 1 to about 3% of total particulate content of said fourth fraction is greater than 20 mesh.

42. The process of claim 41 wherein the fluid is water.

43. The process of claim 18 which further comprises adding additional fluid to a zone defined by said upwardly diverging wall at a rate of up to about 3,000 gpm.

44. The process of claim 43 wherein said rate is from about 200 gpm to about 1,500 gpm.

45. The process of claim 44 wherein said rate is about 1,000 gpm.

46. The process of claim 43 wherein said additional fluid is added through from about 1 to about 6 pipes vertically fixed for introducing said additional fluid into said zone.

47. The process of claim 43 wherein said additional fluid is added through from 1 to about 6 pipes fixed for introducing said additional fluid tangentially into said zone.

* * * * *